US007033112B2

(12) United States Patent
Rijlaarsdam

(10) Patent No.: US 7,033,112 B2
(45) Date of Patent: Apr. 25, 2006

(54) WATER-RETAINING STRUCTURE

(76) Inventor: Cornelis Elizabeth Rijlaarsdam, Boddens Hosangweg 84, 2481 La Woubrugge (NL)

( * ) Notice: Subject to any disclaimer, the term of this patent is extended or adjusted under 35 U.S.C. 154(b) by 0 days.

(21) Appl. No.: 10/978,569

(22) Filed: Nov. 1, 2004

(65) Prior Publication Data

US 2005/0100411 A1 May 12, 2005

Related U.S. Application Data

(63) Continuation of application No. 10/243,513, filed on Sep. 13, 2002, now abandoned, which is a continuation of application No. PCT/NL01/00218, filed on Mar. 16, 2001.

(30) Foreign Application Priority Data

Mar. 18, 2000 (NL) ..... 1014688
Jan. 15, 2001 (NL) ..... 1017109

(51) Int. Cl.
*E02B 3/10* (2006.01)

(52) U.S. Cl. ..... 405/87; 405/107; 405/90; 405/100; 405/102

(58) Field of Classification Search ..... 405/90, 405/94, 95, 99, 100, 102, 101, 107

See application file for complete search history.

(56) References Cited

U.S. PATENT DOCUMENTS

| | | | | |
|---|---|---|---|---|
| 579,349 | A | | 3/1897 | Marshall |
| 1,120,787 | A | * | 12/1914 | Bebout ..... 405/102 |
| 1,754,108 | A | | 4/1930 | Jermar |
| 2,118,404 | A | | 5/1938 | Jermar |
| 2,701,953 | A | | 2/1955 | Travilla |
| 3,775,983 | A | | 12/1973 | Aubert |
| 4,352,592 | A | | 10/1982 | Aubert |
| 5,199,812 | A | | 4/1993 | McClellan |
| 5,470,177 | A | | 11/1995 | Hughes |
| 5,758,989 | A | | 6/1998 | Snowberger |
| 6,132,140 | A | | 10/2000 | Kullberg |
| 6,196,764 | B1 | | 3/2001 | Bayssiguier |

FOREIGN PATENT DOCUMENTS

| | | |
|---|---|---|
| CH | 640 289 | 12/1983 |
| DE | 287 555 | 9/1915 |
| DE | 696 664 | 9/1940 |
| DE | 3 401 010 | 7/1985 |
| DE | 299 11 655 | 12/1999 |
| DE | 299 16 355 | 3/2000 |
| EP | 0 994 219 | 4/2000 |
| NL | 9 201 601 | 4/1994 |
| WO | 9718369 | 5/1997 |

* cited by examiner

*Primary Examiner*—Frederick L. Lagman
(74) *Attorney, Agent, or Firm*—Ladas & Parry LLP

(57) ABSTRACT

Device for retaining water comprising a foundation, a retaining wall movably attached to the foundation and a shore movably, particularly hingingly, attached to the foundation, in which the shore and the retaining wall are movably, particularly hingingly, attached to each other, and in which the retaining wall is provided with at least an internal longitudinal hinge about which the retaining wall can be turned.

40 Claims, 7 Drawing Sheets

Fig.2
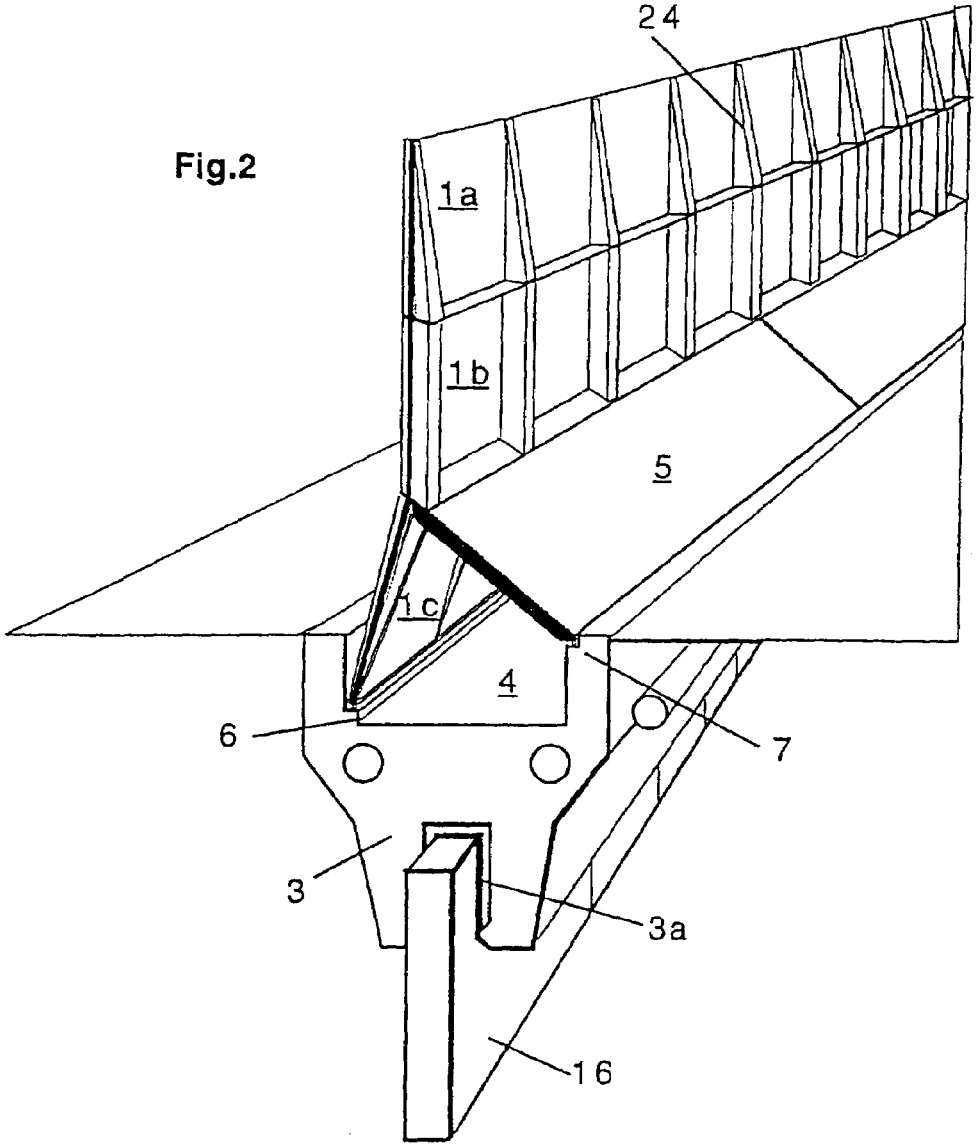
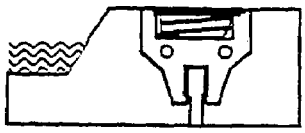
Fig.3A
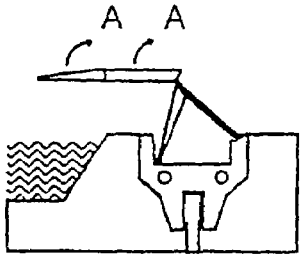
Fig.3B
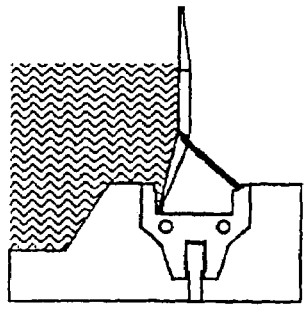
Fig.3C

WATER-RETAINING STRUCTURE

This is a continuation of application Ser. No. 10/243,513 filed on Sep. 13, 2002 now abandoned which is a continuation of International Application PCT/NL01/00218 filed on Mar. 16, 2001, which designated the U.S., claims the benefit thereof and incorporates the same by reference.

The invention relates to a water-retaining structure that may be latently present and in case of high tide/flood to be retained can be erected.

Such water-retaining structures have been widely known for a long time. The weirs in deltas or-rivers, such as storm surge barriers, but also structures to be put on dikes or quays, such as De Muralt walls or inflatable tubes come to mind here.

Such structures offer a provision for temporarily increasing the water-retaining height. This may be a solution in case the water-retaining main body offers an insufficient height for an economically acceptable barrier. In that case the foot of the main body need not be adjusted. This becomes more and more important, due to the rising average sea water level and the ever increasing river discharge.

It may regard the provision of a water-retaining structure for an urban area, but also for a rural area, in case the damage to be expected is high enough, and furthermore for industrial zones, such as brickworks, that are situated in an area of increased inundation risk.

A problem occurring here is that the space available often is too limited.

It is an object of the invention to provide a water-retaining structure which in the inoperative position takes up little space.

A further object of the invention is to provide a water-retaining structure that is easy to place.

Yet a further object of the invention is to provide a water-retaining structure that can quickly be erected from the inoperative position into an operative position.

From one aspect the invention to that end provides a device for retaining water comprising a foundation, a retaining wall movably attached to the foundation and a shore movably, particularly hingingly, attached to the foundation, in which the shore and the retaining wall are movably, particularly hingingly, attached to each other, and in which the retaining wall is provided with at least an internal longitudinal hinge about which the retaining wall can be turned.

In this way the water-retaining wall can be folded and unfolded, respectively, onto itself, so that in the non-operative position little space is taken up whereas the retaining wall can be completely active in the retaining position.

The water-retaining structure according to the invention as a result is very suitable for placement at a location where there is little space, such as on a dike.

Preferably the retaining wall is provided with several internal longitudinal hinges situated at transverse distance from each other, so that it can be folded down several times and the space it takes up in folded position can even be relatively smaller.

Preferably the retaining wall can be folded and unfolded between a non-operative position, in which the retaining wall is substantially horizontally situated, and a raised, retaining operative position. In this way the size of the structure, particularly in vertical direction in the foundation, can be kept limited. The raised operative position can be substantially vertical.

Preferably the longitudinal hinge is adapted for a hinging movement on the side of the water to be retained, in which the retaining wall preferably is provided with stop means for limiting the rotation of the longitudinal hinge. The folding movement of the retaining wall members will take place here at the water side, where there is free space. Furthermore the water pressure in the water to be retained will cooperate in keeping the retaining wall unfolded.

Preferably means are provided for locking the longitudinal hinge in the upright position of the retaining wall, so that a rigid wall can be obtained.

In a preferred embodiment an internal longitudinal hinge, particularly the lowermost, is situated at the location of the connection of the shore to the retaining wall. In this way two connections almost coincide, as a result of which it is possible that the limiting or locking means are also adapted for securing the shore to the retaining wall.

In a further development of the water-retaining structure according to the invention the foundation is provided with an accommodation space for the retaining wall in a position folded about the at least one longitudinal hinge. The accommodation space protects the water-retaining structure when not used, in which both margin areas of the accommodation space can also serve as support for the shore and the retaining wall.

Preferably the foundation comprises a substantially U-shaped body.

When the foundation is provided with a base plate extending downward from it, said plate not only has a founding function, but it also counteracts the flow of water underneath the water-retaining structure, which is of importance in case of placement in/on a body of a dike.

The shore can be hinged between a sideward downfolded position and an operative position, and in downfolded position can be accommodated in the accommodation space.

The use of the accommodation space renders it possible that the retaining wall forms a lid for the accommodation space, as a protection, but possibly as a road surface as well, for public transport or for inspection. Due to its water-retaining construction the retaining wall will be suitable for carrying traffic loads.

Alternatively the shore may be plate-shaped. In case of—wanted or unwanted—overflowing water, the shore may serve as landsided guidance for said water. In case at least one of the connections of retaining wall and shore to the foundation can be moved in horizontal direction, a water-retaining structure is obtained of which the crown level can be manipulated.

From a further aspect the invention provides a device for retaining water comprising a foundation, a retaining wall movably attached to the foundation and a shore movably, particularly hingingly, attached to the foundation, in which the shore and the retaining wall are movably, particularly hingingly, attached to each other, and in which at least one of the connections of the retaining wall and shore to the foundation can be moved and adjusted in horizontal direction, preferably continuously variable and in a driven manner.

The water-retaining structure can in that form be used as spillway for deflecting water in a high water/tide wave in a river to an overflow area at the wanted moment. The water-retaining structure, however, can also be deployed in overflow areas for high sea water.

The water-retaining structure may to that end be incorporated in the crown of body of a dike, in which the connections with the foundation are situated at a distance below the dike crown. Thus a chosen passage below the dike crown can be realised, so that water can be let through before the water level has risen to the crown level and otherwise water would spill at any location along the dike.

The invention further relates to an assembly of a number of water-retaining structures according to the invention, arranged in line, in which the retaining walls can be separately erected and folded.

The invention will be elucidated on the basis of a number of exemplary embodiments shown in the attached drawings, in which:

FIG. 2 shows the water-retaining structure of FIG. 1, in a slightly adjusted form, and in series in erected position;

Figure 1:
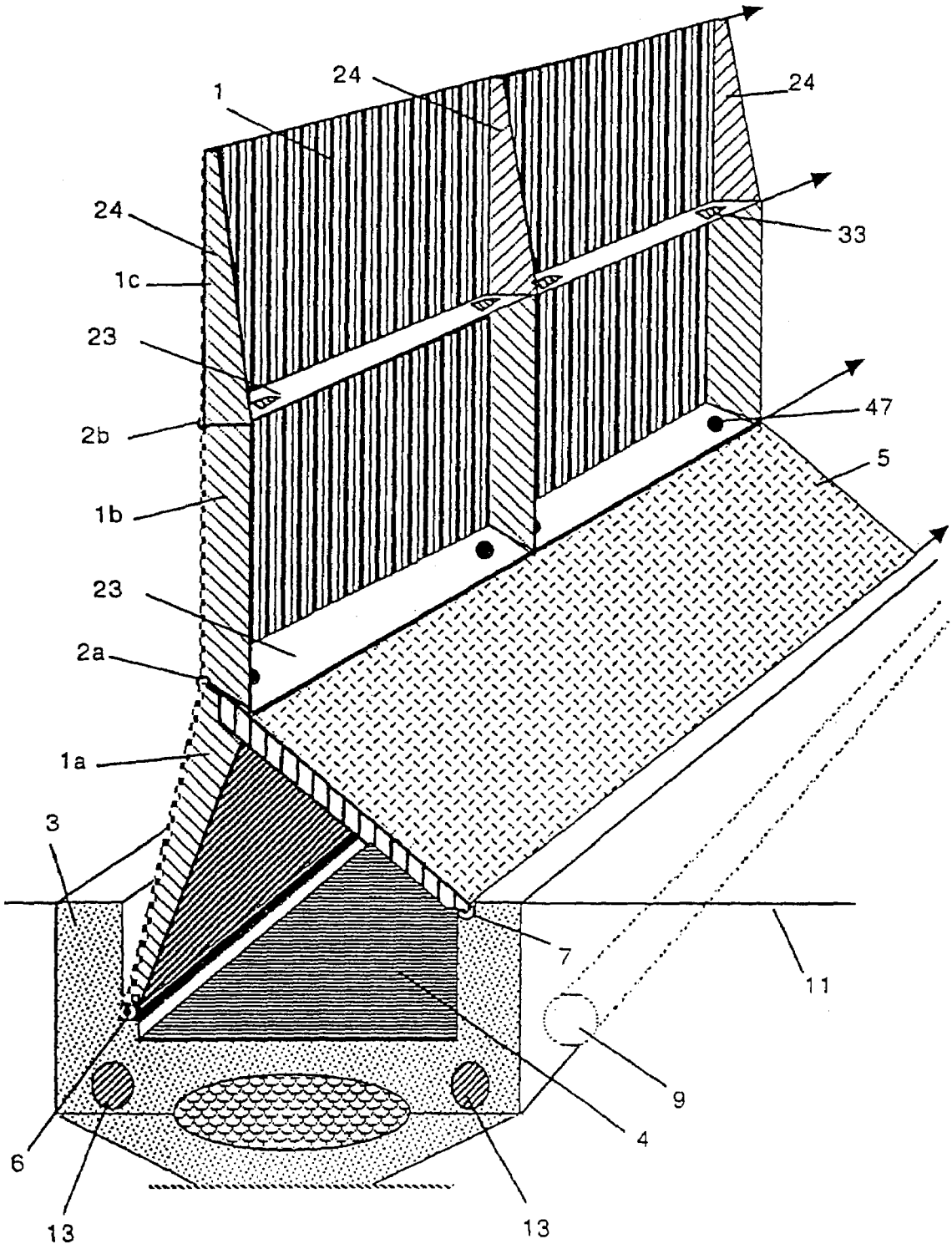
FIG. 1 shows a first embodiment of a water-retaining structure according to the invention in erected position.
Figure 4:
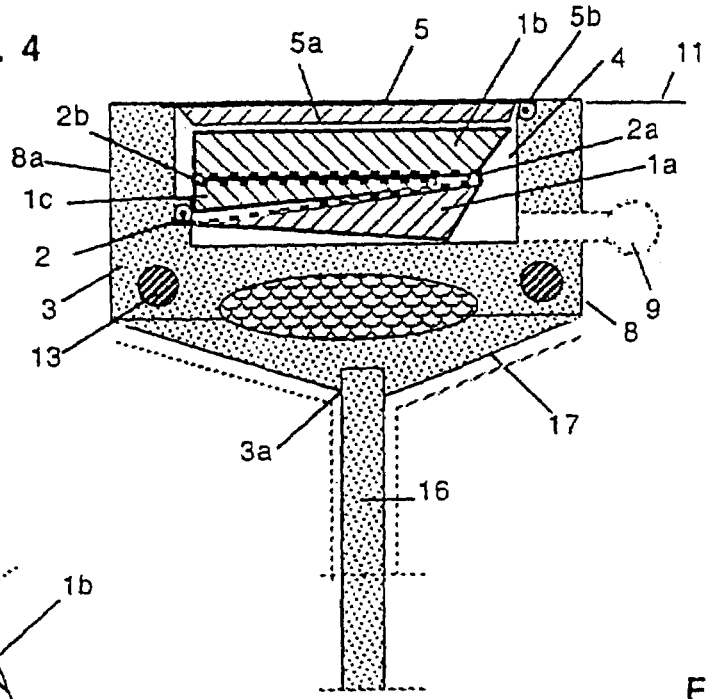
Figure 5:
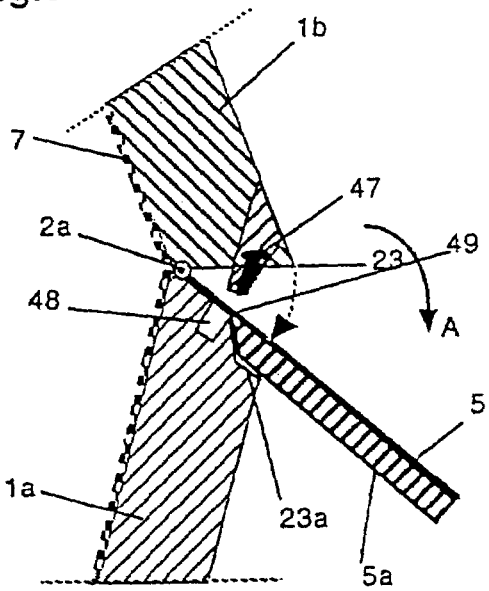
Figure 6:
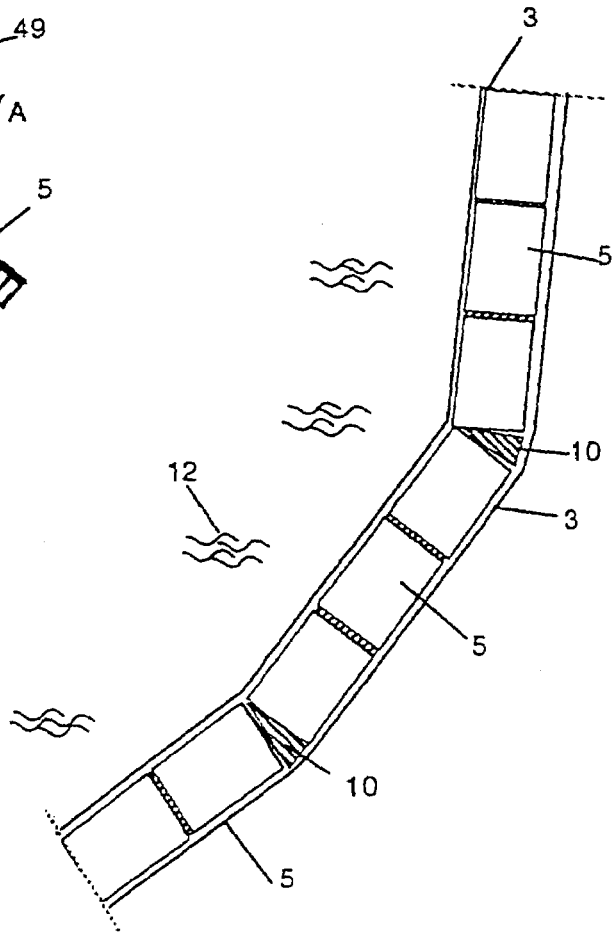
Figure 5A:
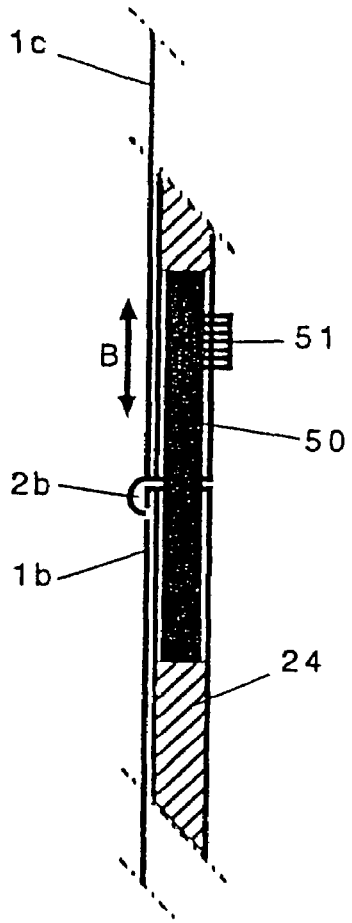
Figure 7:
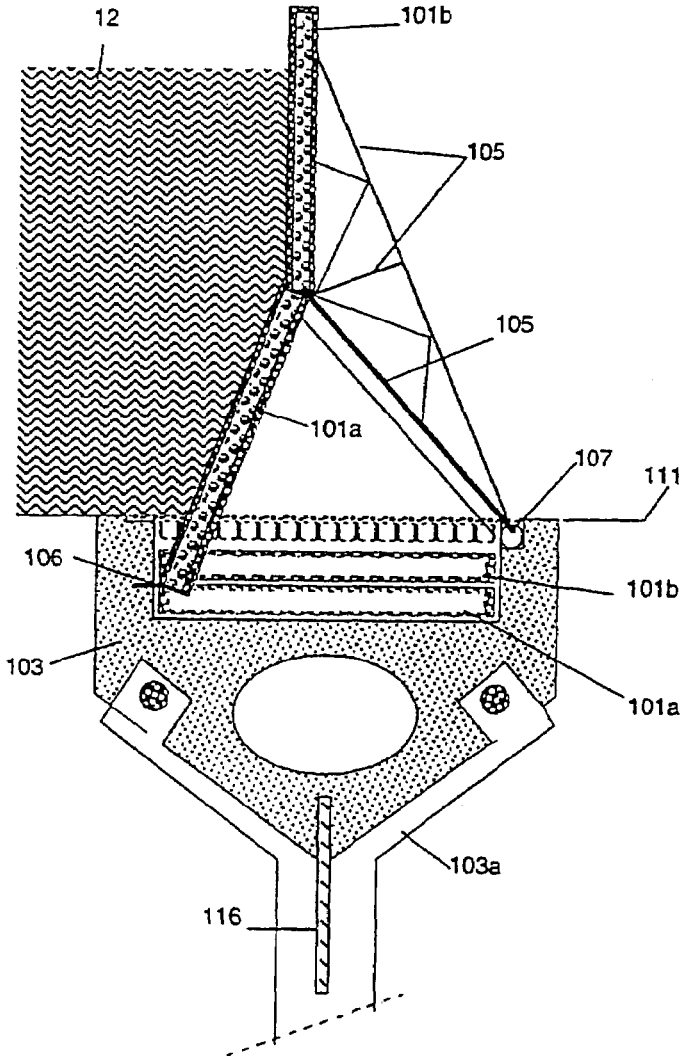
Figure 8:
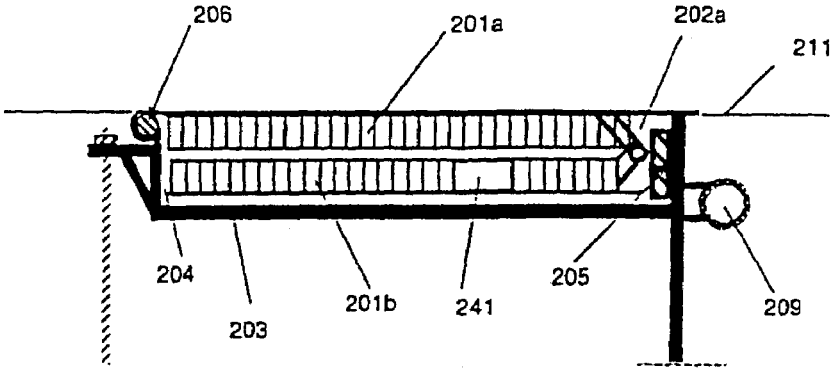
Figure 9:
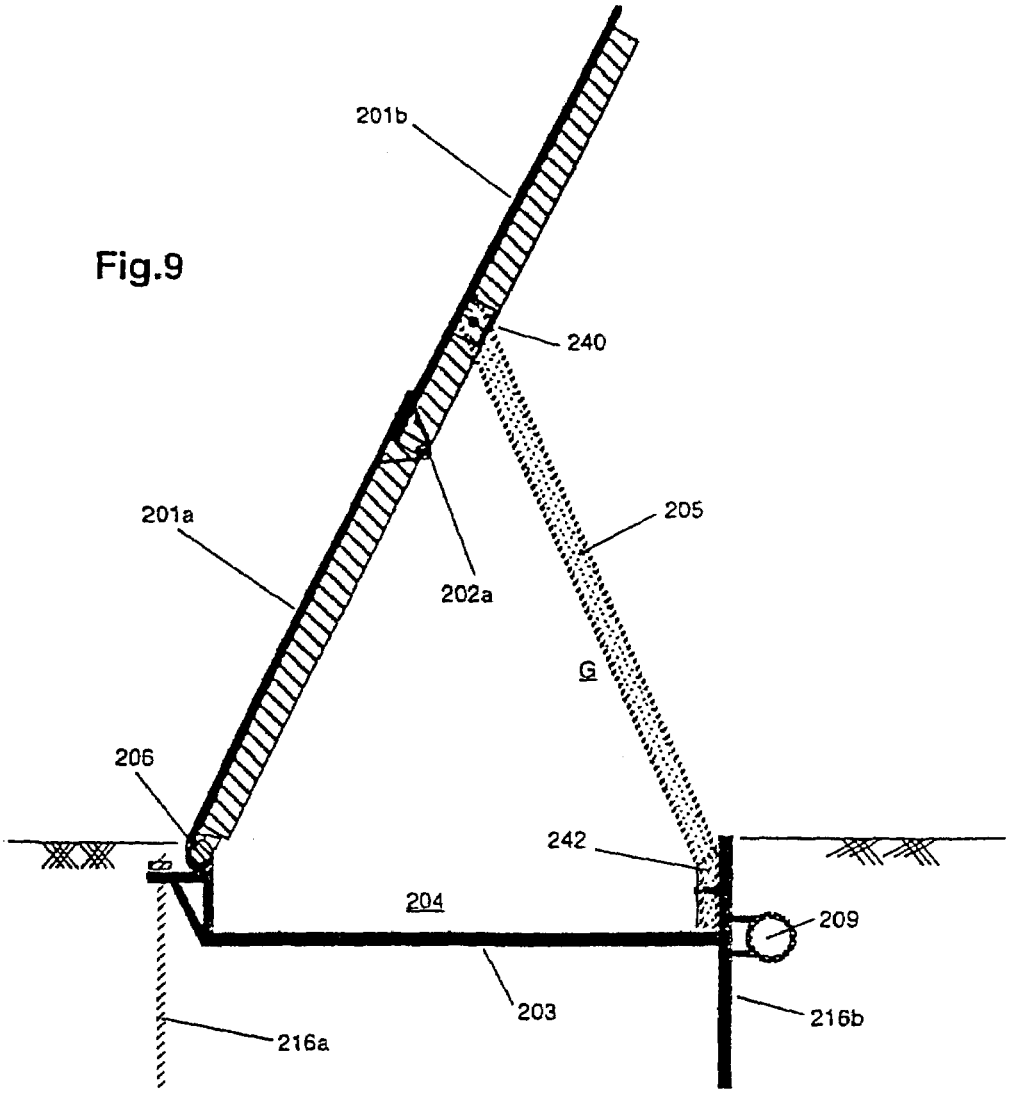
Figure 10:
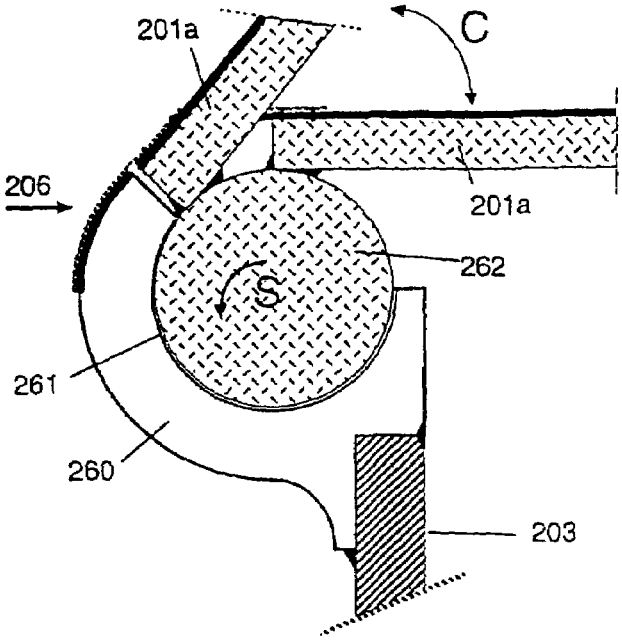
Figure 10A:
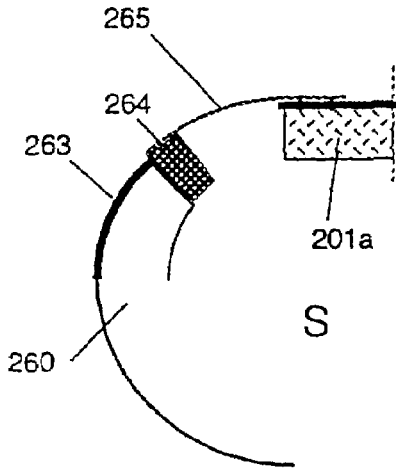
Figure 11A:
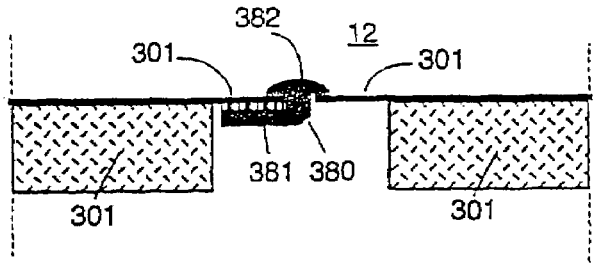
Figure 11B:
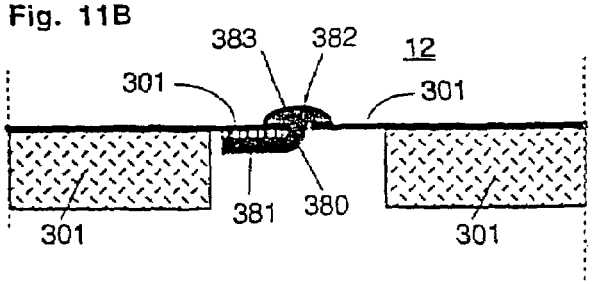
Figure 11C:
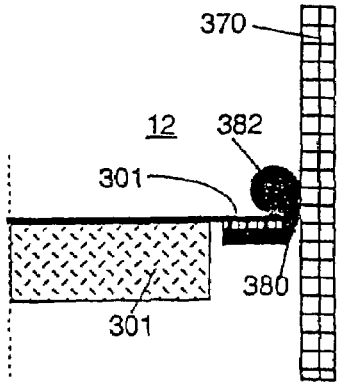
Figure 12:
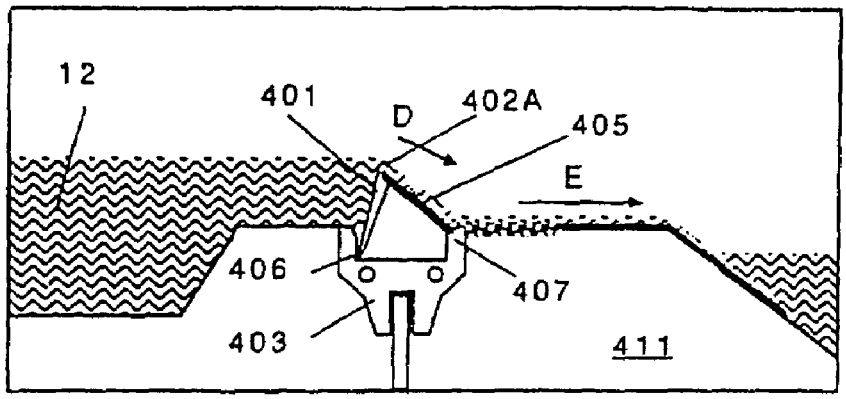
Figure 13A:
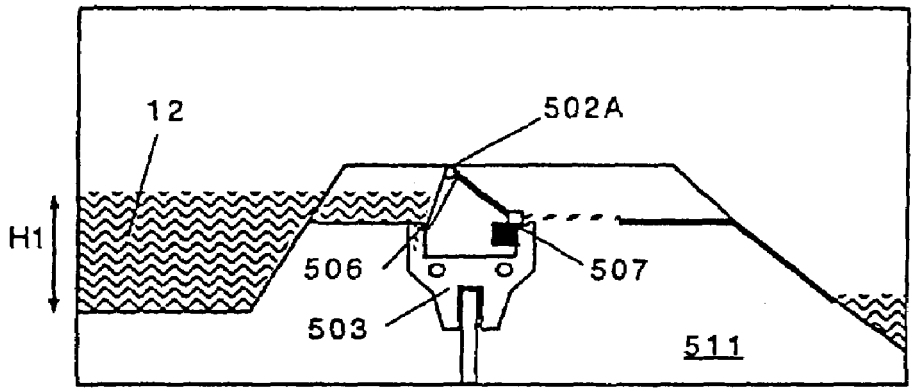

FIGS. 3A–C shows the water-retaining of FIG. 2, in various positions;

FIG. 4 shows a cross-section of the water-retaining structure of FIG. 1 in folded position;

FIG. 5 shows a detail of a hinge in the water-retaining structure of FIGS. 1 and 2;

FIG. 5A shows a detail of a locking of another hinge in the water-retaining structure of the preceding figures;

FIG. 6 shows a schematic top view of an arrangement with a water-retaining structure according to the invention;

FIG. 7 shows an alternative embodiment of a water-retaining structure according to the invention;

FIGS. 8 and 9 show a further alternative of a water-retaining structure according to the invention;

FIG. 10 shows a detail of a hinge bearing in the water-retaining structure of FIGS. 8 and 9;

FIG. 10A shows a further elucidation of it;

FIGS. 11A–C shows some connection details between adjacently placed water-retaining structures according to the invention; and FIG. 12 shows a possible other arrangement of a water-retaining structure according to the invention;

FIGS. 13A,B show some possible arrangements of water-retaining structures according to the invention as a spillway.

The water-retaining structure in FIG. 1 comprises a retaining wall 1, which, in this example, consists of three wall members 1*a*, 1*b* and 1*c*, which are hingingly connected to each other by means of longitudinal hinges 2*a*, 2*b*. The retaining wall members 1*a*, 1*b* and 1*c* can be made of metal plate, and reinforced by vertical girders 24 and by horizontal girders 23. As is suggested in FIG. 2, the vertical girders 24 may also be box girders.

The water-retaining structure is furthermore provided with a shore plate 5, which may also be made of metal, and which may be provided with reinforcement girders at the bottom side (which is not shown).

Both the retaining wall 1 and the shore plate 5 are hingingly mounted at the location of 6 or 7, respectively. At that location the water-retaining structure is supported on a U-shaped concrete foundation 3, which is sunk into the crown of a body of a dike 11. In a similar way 11 may also refer to a quay or the like.

The foundation 3, also shown in FIG. 2, forms an accommodation space 4 and has longitudinal holes 13, in which connecting pens 21 can be inserted, for coupling the adjacently situated foundations 3 in longitudinal direction. At the lower end, the foundation 3 may merge into an inverted U-shape 3*a*, for fitting engagement of a ground sealing plate 16, which may have a function in transferring vertical forces, but also in the prevention of a horizontal waterflow through the body of a dike. Depending on the ground characteristics, the plate 16 may extend more or less deeply. During the penetration of the plate 16 into the ground, said ground may be compacted under conditions, as a result of which the leakage flows are further counteracted.

As can be seen the longitudinal hinge t is situated near the bottom of the accommodation space 4, and the hinge 7 is situated near its top side. As a result it is possible that the retaining wall 1 in folded position—shown in FIG. 4, in which the wall member 1*c* had been folded down onto wall member 1*b* and the assembly of wall members 1*b* and 1*c* has been folded down onto wall member 1*a*—has been horizontally and appropriately accommodated in the accommodation space 4, but that just above it there still is room for horizontal placement of the shore plate 5. As can been seen in FIG. 4 the shore plate 5 is supported on both longitudinal edges of the accommodation space 4. Furthermore a discharge line 9 is shown for water that has unwantedly ended up in accommodation space 4.

As can been seen in FIG. 5 a locking pin 47 has been provided at the lower edge of wall member 1*b*, and a cavity 48 intended for said locking pin has been provided in the opposite upper edge of wall member 1*a*. When wall member 1*b* is swung in the direction A with respect to wall member 1*a* during erecting the retaining wall 1, said lower edge and upper edge form a stop one to the other, which is a limitation fro the hinging movement in the direction A. The limit is reached in the situation shown in FIG. 1.

Special here is that the connection in question is also used for securing the shore plate 5 by engagement. To that end the upper edge of wall member 1*a* is shaped to match the free edge of shore plate 5. In its free edge the shore plate 5 is provided with holes 49, for passage of a locking pin 47. After a triangle has been formed by erection, the hinges 6, 7 and the bearing of the edge of shore plate 5 on the upper edge of wall member 1 constituting the vertices of the triangle, rotation in the direction A of wall member 1*b* until abutment against the edge of shore plate 5 and insertion of the locking pins 47 in the holes, will ensure fixation of the plates 1*a*, 1*b* and 5 in the position shown in FIG. 1. The plate 5 will then as it were be clamped in between the wall members 1*a* and 1*b*. It is also possible that the plate 5 has been provided with a downwardly extending rib or a series of protrusions, which fit in a continuous cavity 48 (or a series of cavities 48), and that the locking pins can extend through them, or that separate cavities 48 have been provided to that end.

In FIG. 5A it is shown how the position of the wall members 1*b* and 1*c* in FIG. 1 can also be secured. The wall member 1*c* is provided here with a number of locking pins 50 that can be slid along said wall member, which pins may be engaged by protrusion 51. They can be reciprocally vertically slid in the direction B and may be accommodated in sleeves 24, shown in FIG. 2.

The upper edge of the extension of the sleeves 24 in wall member 1*b* is suitable for receiving the locking pins 50. As soon as the wall members 1*a* and 1*b* are folded out to be aligned with each other, as shown in FIG. 1, the locking pins 50 are operated by lowering them from the position in which they are entirely accommodated in wall member 1*c* into the snug accommodation spaces in the sleeves 24 of wall member 1*b*.

It is emphasized that these are but a number of possible-examples and that other locking mechanism are possible as well.

The FIGS. 3A–C schematically show how the erection generally takes place. The situation shown in FIG. 3A corresponds to the one of FIG. 4, and the situation shown in FIG. 3C corresponds to the one shown in FIG. 1. First the shore plate 5 is folded out, so that the folded retaining wall 1 can be reached. If necessary means may be provided for keeping the shore plate 5 in the wanted position. If necessary the shore plate 5 can be kept vertical for a short while. Subsequently the wall member 1*b* is turned upwards in the direction A and simultaneously or subsequently the wall member 1*c*. The locking of the end positions can take place as mentioned above. The fold out direction here is facing away from the high water.

The result is a slim retaining wall or water-retaining structure, which despite the horizontal direction takes up little room and is still able to extend sufficiently high.

In the folded in position the shore wall or shore plate may serve as traffic lane. Also in cases of emergency all locations of the water-retaining structure can be easily reached everywhere over it, in order to erect the water-retaining structure at the wanted locations.

FIG. 6 shows a number of water-retaining structures according to the preceding figures arranged on a body of a dike 11, in which the curve of the body of a dike 11 is followed. The water-retaining structures each have three shore plates 5 here. The intermediate spaces between the consecutive water-retaining structures are filled with tapering filling bodies 10, as a result of which both bends to the left and to the right can be followed. The water-retaining structure is shown here in folded position.

In FIG. 7 an alternative embodiment of the water-retaining structure according to the invention is shown, in which a difference with the previous embodiment is the fact that now there are only two retaining wall members 1*a* and 1*b*, and a number of lattice structure-like shore constructions 105 spaced apart in longitudinal direction of the water-retaining structure, which shore constructions 105 can be folded in or can be unfolded in longitudinal direction of the water-retaining structure about hinge 107. Comparable construction parts have the same reference numbers, increased by 100. In this case as well, the hinge for the retaining wall is situated lower than the one for the shore, and the lowermost retaining wall member 101*a* is the last one to be laid in the accommodation space 104. The lattice structure like shore construction 105 also supports the wall member 101*b* over a considerable part of its height.

In FIG. 8 a comparable alternative embodiment of the water-retaining structure is shown, which is also built up from two retaining wall members 200*a*, 201*b* that are hingingly connected to each other at the location of 202*a*. At the location of 206 the retaining wall member 201*a* is hingingly connected to the foundation 203, which in this case consists of a steel container defining the accommodation space 204. At the land side, the foundation 203 is provided with a sheet piling 216*b* (also see FIG. 9) which also forms a water-retaining screen, and further with poles 216*a* at the waterside. Just like in the embodiment of FIG. 1 the accommodation space 204 is drained and water can be discharged by means of discharge line 209, extending in longitudinal direction of the water-retaining structure.

In this example the retaining wall member 201*b* that is situated above in the active position, lies beneath the retaining wall member 201*a* when in the storage position. The hinging movement during erection therefore is different from the one in the preceding figures, and now in direction G.

At its upper edge, as can be seen in FIG. 9, the retaining wall member 201*a* itself forms a stop against retaining wall member 201*b* tilting through too far.

At the location of hinge 207, of which the horizontal axis of rotation lies in the plane of drawing, the shore 205 is hingingly connected to the foundation 203. When erecting, the shore rod 205 can be erected into the position shown in FIG. 9, in order to be coupled in a secure way at the location of 240 to coupling provision 241 that is not further shown in retaining wall member 201*b*. The hinge 202*a* can be fixated or locked in the position shown in FIG. 9 with means that are not further shown, for instance corresponding to the locking with locking pins according to FIG. 5A, in order to rule out any risk of swinging through.

It is noted that in this example a sealing of the accommodation space 204 is ensured by the retaining wall member 201*a* itself. The shore 205 may be provided with a hinge 242, so that, as shown in FIG. 8, it may be accommodated folded down next to the folded assembly of retaining wall members 201*a* and 201*b* in the accommodation space 204. The unfolding direction here is towards the water to be retained.

In the FIGS. 10 and 10A a possible embodiment of the hinge 206 of the water-retaining structure of the FIGS. 8 and 9 is shown. At the foundation 203*a* hinge seat 260 has been welded, which forms a straight circle-cylindrical bowl 261 for the hinge rod 262, which is welded to retaining wall member 201*a*. When erecting the retaining wall member 201*a* in the direction C it will rotate together with the hinge rod 262 about the hinge point S.

In order to prevent leakage at the location of the hinge point, the longitudinal edge of the retaining wall member 201*a* situated at the water side may, as shown in FIG. 10A, be provided with an arched extending skirt 265 and the hinge seat 260 with a rubber guidance coating 263 at the top outside, which coating ends in a hardwood beam 261. When erecting and folding the retaining wall member 201*a* the skirt 265, which may be made of stainless steel, will run over the beam 264 and over the rubber coating 263. The rubber ensures permanent sealing, whereas the wooden beam has a heat-insulating working for the rubber layer 263 and serves as guidance and bearing point for the stainless steel skirt 265.

A water-retaining structure will usually have a very long length, and will therefore, as has already been suggested in FIG. 6, consist of several units. Between said units such sealing measures need to be taken that disturbing leakage is prevented. Examples of how to do this are shown in the FIGS. 11A–C, in which the retaining wall members 301 have been provided with transverse end edges 301'. One of the edges 301' is provided with a rubber strip 380 attached to it, which strip itself is provided with an attachment strip 381, and a head 382. Said head 382 is mushroom-shaped, in order to sealingly abut both edge areas 301' at the waterside.

As suggested in FIG. 11B the head 382 may be provided with a metal protective hood 383, for protection and increasing its life span.

In the FIG. 11C the possible connection is shown against a fixed wall 370. It is noted that use is made here of a sealing material 380 that is UV-resistant and is resilient during either the erecting or folding-down movement of the water-retaining structure.

In FIG. 12 in which the same parts are referred to with the same reference numbers increased by a hundred, there is only one retaining wall member 401, and a shore plate 405. In this case the retaining-wall member 401 at the location of 406 is hingingly connected to the foundation 403 and the shore plate 405 is hingingly connected at the location of hinge 407. The retaining wall here consists of one single plate, and at the location of hinge 402*a* an overflow will be present, if so desired. If a higher retaining structure is desired, segments can be attached to the single retaining wall, for instance two (such as in FIG. 1) or one (such as in FIG. 7).

Figure 13B:
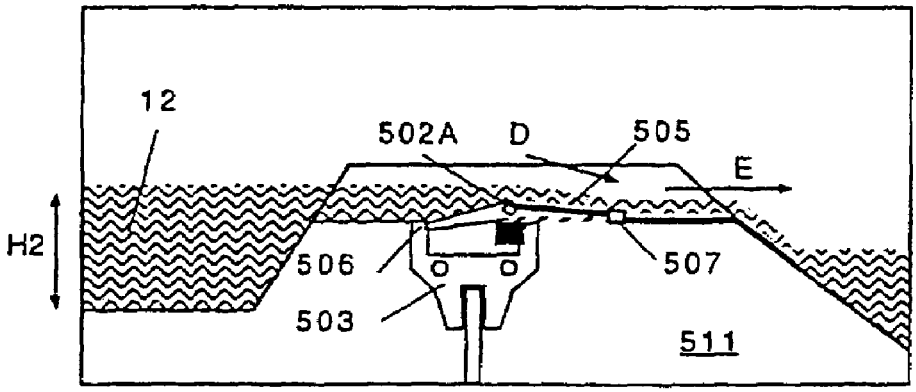

The structure according to the invention can also be used as an adjustable spillway, such as shown in FIGS. 13A and 13B.

In FIG. 13A it is shown that such a construction can also be accommodated, recessed in a body of a dike 511. Here the highest position of the hinge point 502*a* is almost equal to the crown of the body of the dike 511. The hinge 507 is still at the location of the foundation 503, and the water level is H1. In FIG. 13B the hinge 507 has been moved slightly to the right in a continuously variable manner with means that are not further shown, and it is retained there, and the water-retaining level is H2. Said level H2 is too low for retaining water of the level H1, so that in the intermediate period water has been able to flow away in the direction D over the hinge 502*a* and over the shore plate 505, to a flood plain, grassed waterway or the like. By moving the hinge 507 in the direction E a water spillway can be formed which is situated below crown level.

The invention claimed is:

1. Device for retaining water comprising a support, a retaining wall for retaining water permanently and movably attached to the support and a shore permanently and movably attached to the support, in which the retaining wall comprises at least two movable wall members which are connected to each other by means of at least one longitudinal hinge about which the thereby connected wall members can be turned relative to the other between a turned position and a water-retaining upturned position, in the water-retaining position of the retaining wall the shore and the retaining wall being attached to one another to keep the retaining wall in the water-retaining position.

2. Device according to claim 1, in which the retaining wall is provided with several internal longitudinal hinges connecting respective movable wall members.

3. Device according to claim 1, in which the turned position is substantially horizontal, and the upturned position is substantially vertical.

4. Device according to claim 1, in which the longitudinal hinge is adapted for a hinging movement on the side of the water to be retained.

5. Device according to claim 4, in which the retaining wall is provided with stop means for limiting the rotation of the longitudinal hinge.

6. Device according to claim 4, furthermore provided with means for locking the longitudinal hinge in the upright position of the retaining wall.

7. Device according to claim 1, in which the at least one longitudinal hinge is situated at the location of the attachment of the shore with the retaining wall.

8. Device according to claim 7, in which the retaining wall comprises at least three movable wall members which are connected to each other by means of a longitudinal hinge, a lowest internal longitudinal hinge being situated at the location of the attachment of the shore with the retaining wall or above it.

9. Device according to claim 1, furthermore provided with means for locking the at least one longitudinal hinge in the upright position of the retaining wall, in which the at least one longitudinal hinge is situated at the location of the attachment of the shore with the retaining wall, in which the retaining wall is provided with stop means for limiting the rotation of the longitudinal hinge, the stop means being also adapted for securing the shore to the retaining wall.

10. Device according to claim 1, in which the support is provided with an accommodation space for forming a tray for accommodation of the retaining wall in a position folded about the at least one longitudinal hinge, wherein the tray is limited by a first longitudinal edge and a second longitudinal edge, said first longitudinal edge being located closer to the water than the second longitudinal edge, wherein said retaining wall is movably attached to the support at the first longitudinal edge of the tray.

11. Device according to claim 10, in which the support comprises a substantially U-shaped body defining the accommodation space.

12. Device according to claim 10, wherein the shore is movably attached to the second longitudinal edge of the tray.

13. Device according to claim 10, in which the support is provided with a base plate extending downward from it.

14. Device according to claim 10, the longitudinal hinge having a longitudinal axis in which the shore can be hinged between a sideward downfolded position and an operative position by hinging movement about an axis that is perpendicular to the longitudinal axis and in which the shore in the downfolded position is accommodated in the accommodation space.

15. Device according to claim 10, in which the retaining wall forms a lid for the accommodation space.

16. Device according to claim 10, in which the shore is plate-shaped and forms a lid for the accommodation space.

17. Device according to claim 1, the longitudinal hinge having a longitudinal axis, in which the shore can be hinged between a sideward downfolded position and an operative position by hinging movement about an axis that is perpendicular to the longitudinal axis.

18. Device according to claim 1, in which the shore is plate-shaped.

19. Device according to claim 18, in which a lower wall member of the retaining wall has an upper edge and in which the shore plate has a free edge, the upper edge of the lower wall member being shaped to match the free edge of the shore plate.

20. Device according to claim 19, in which the shore plate is secured to the retaining wall by being clamped between said movable wall members.

21. Device according to claim 18, in which the plate-shaped shore extends parallel to the longitudinal hinge and is movably attached to the support by means of a longitudinal hinge.

22. Device according to claim 1, accommodated in the crown of a body of a dike.

23. Device according to claim 1, arranged in a quay.

24. Device according to claim 1, in which the support is a foundation.

25. Device according to claim 1, in which the retaining wall is hingedly attached to the support.

26. Device according to claim 1, in which the retaining wall is hingedly attached to the shore.

27. Device according to claim 1, in which the support is provided with an accommodation space forming a tray for the accommodation of at least one of the wall members when the retaining wall is moved relative to the support to the turned position.

28. Device according to claim 1, in which the shore is adapted for being secured to the retaining wall by engagement, in the water retaining position of the retaining wall.

29. Device according to claim 28, in which the shore is secured by being clamped between said movable wall members.

30. Device according to claim 1, in which the shore is adapted for being coupled to the retaining wall, in the water retaining position of the retaining wall.

31. Device according to claim 30, in which the shore can be hinged between a sideward downfolded position and an operative position about a horizontal hinge axis that is perpendicular to the longitudinal hinge.

32. Device according to claim 31, in which the support is provided with an accommodation space for the retaining wall in a position folded about the at least one longitudinal hinge, wherein the tray is limited by a first longitudinal edge and a second longitudinal edge, said first longitudinal edge being located closer to the water than the second longitudinal edge, wherein said retaining wall is movably attached to the support at the first longitudinal edge of the tray, and in which the shore can be hinged between a sideward downfolded position and an operative position and in which the shore in down folded position is accommodated in the accommodation space.

33. Device according to claim 1, in which the shore and the retaining wall are permanently and movably attached to each other.

34. Device according to claim 33, in which the shore and the retaining wall are hinged to each.

35. Device according to claim 1, in which the shore is hinged to the support.

36. Device for retaining water comprising a support, a retaining wall hingedly attached to the support and a shore spaced from the retaining wall along the support in a generally horizontal direction and hingedly attached to the support, in which the shore and the retaining wall are movably attached to each other, and in which at least one of the hinged attachments of the retaining wall and shore with the support is movable along the support relative to the other.

37. Device according to claim 36, in which at least one of the hinged attachments of the retaining wall and shore with the support can be moved and adjusted in horizontal direction continuously variably and in a driven manner.

38. Device according to claim 36, in which the connections with the support are situated at a distance below the dike crown.

39. Device according to claim 38, in which the hinged attachments with the support are situated at a distance below the dike crown.

40. Device for retaining water comprising a support, a retaining wall for retaining water permanently and hingedly attached to the support and a shore permanently and hingedly attached to the support, the retaining wall comprising at least two movable wall members connected to each other by at least one longitudingal hinge for turning the wall members thereabout relative to each other between a turned position and a water-retaining upturned position, the shore and the retaining wall being attached to one another in the water-retaining upturned position to keep the retaining wall in the water-retaining upturned position.

* * * * *